US007598932B2

(12) United States Patent
Shin et al.

(10) Patent No.: US 7,598,932 B2
(45) Date of Patent: Oct. 6, 2009

(54) PLASMA DISPLAY APPARATUS AND DRIVING METHOD THEREOF

(75) Inventors: Sunggon Shin, Gyeongsangnam-do (KR); Yunkwon Jung, Gumi-si (KR)

(73) Assignee: LG Electronics Inc., Seoul (KR)

( * ) Notice: Subject to any disclaimer, the term of this patent is extended or adjusted under 35 U.S.C. 154(b) by 700 days.

(21) Appl. No.: 11/267,247

(22) Filed: Nov. 7, 2005

(65) Prior Publication Data

US 2006/0097648 A1 May 11, 2006

(30) Foreign Application Priority Data

Nov. 8, 2004 (KR) ..... 10-2004-0090519

(51) Int. Cl.
*G09G 3/28* (2006.01)

(52) U.S. Cl. ..... 345/60; 345/73; 345/211; 345/61; 345/62; 345/63; 345/64; 345/65; 345/66; 345/67; 345/68; 345/69; 345/70; 345/71; 345/72; 315/169.4; 313/581

(58) Field of Classification Search ..... 345/60–73, 345/211; 315/169.4; 313/581
See application file for complete search history.

(56) References Cited

U.S. PATENT DOCUMENTS 5,081,400 A * 1/1992 Weber et al. ..... 315/169.4
5,642,018 A * 6/1997 Marcotte ..... 315/169.4
6,563,272 B1 5/2003 Dufort ..... 315/169.3
2003/0122735 A1 7/2003 Huang et al. ..... 345/60

FOREIGN PATENT DOCUMENTS

EP 1 267 320 A2 12/2002
EP 1 130 936 A1 5/2003

OTHER PUBLICATIONS

European Search Report dated Jun. 2, 2006.

* cited by examiner

*Primary Examiner*—Richard Hjerpe
*Assistant Examiner*—Ishara T Perumpulliarachchige
(74) *Attorney, Agent, or Firm*—Ked & Associates LLP

(57) ABSTRACT

The present invention relates to a plasma display apparatus and driving method thereof. The plasma display apparatus according to the present invention comprises a Plasma Display Panel (PDP), an energy storage part for recovering energy from the PDP, and an energy supply and recovery controller that forms a current path so that the energy storage part can be charged or discharged. In the energy supply and recovery controller, a reference bias voltage is a negative voltage. The driving method of the plasma display apparatus according to the present invention comprises the steps of supplying energy to the PDP, and maintaining a reference bias voltage of a recovery switch part to a negative voltage when an energy storage part recovers energy from the PDP.

12 Claims, 11 Drawing Sheets

PLASMA DISPLAY APPARATUS AND DRIVING METHOD THEREOF

CROSS-REFERENCES TO RELATED APPLICATIONS

This Nonprovisional application claims priority under 35 U.S.C. § 119(a) on Patent Application No. 10-2004-0090519 filed in Korea on Nov. 8, 2004 the entire contents of which are hereby incorporated by reference.

BACKGROUND OF THE INVENTION

1. Field of the Invention

The present invention relates to a plasma display apparatus and driving method thereof.

2. Background of the Related Art

A plasma display panel (hereinafter, referred to as a "PDP") displays images including characters and/or graphics by light-emitting phosphors with ultraviolet rays generated during the discharge of an inert gas such as He+Xe, Ne+Xe or He+Ne+Xe. This PDP can be easily made thin and large, and it can provide greatly increased image quality with the recent development of the relevant technology.

Referring to FIGS. 1 and 2, a three-electrode AC surface discharge type PDP comprises scan electrodes Y1 to Yn and sustain electrodes Z formed on a bottom surface of an upper substrate 10, and address electrodes X1 to Xm formed on a top surface of a lower substrate 18.

Discharge cells 1 of the PDP are formed at the intersections of the scan electrodes Y1 to Yn and the address electrodes X1 to Xm, and the sustain electrodes Z and the address electrodes X1 to Xm. Each of the scan electrodes Y1 to Yn and the sustain electrodes Z comprises a transparent electrode 12, and a metal bus electrode 11, which has a line width narrower than that of the transparent electrode 12 and is disposed at one side edge of the transparent electrode. The transparent electrode 12 is generally formed of Indium Tin Oxide (ITO) and is formed on the bottom surface of the upper substrate 10. The metal bus electrode is generally formed of metal and is formed on the transparent electrode 12. The metal bus electrode functions to reduce a voltage drop incurred by the transparent electrode 12 with high resistance.

An upper dielectric layer 13 and a protection layer 14 are laminated on the bottom surface of the upper substrate 10 in which the scan electrodes Y1 to Yn and the sustain electrodes Z. Wall charges generated during the discharge of plasma are accumulated on the upper dielectric layer 13. The protection layer 14 serves to prevent the electrodes Y1 to Yn and Z and the upper dielectric layer 13 from sputtering generated during the discharge of plasma, and enhance emission efficiency of secondary electrons. Magnesium oxide (MgO) is generally used as a material of the protection layer 14.

The address electrodes X1 to Xm are formed on the lower substrate 18 in such a way as to cross the scan electrodes Y1 to Yn and the sustain electrodes Z. A lower dielectric layer 17 and barrier ribs 15 are formed on the lower substrate 18. A phosphor layer 16 is formed on surfaces of the lower dielectric layer 17 and the barrier ribs 15. The barrier ribs 15 are formed parallel to the address electrodes X1 to Xm to physically divide the discharge cells and preclude ultraviolet rays generated upon discharge and a visible ray from leaking to neighboring discharge cells. The phosphor layer 16 is excited and light-emitted with ultraviolet rays generated during the discharge of plasma discharge, thus generating any one of red, green and blue visible rays.

An inert mixed gas, such as He+Xe, Ne+Xe or He+Ne+Xe, is injected into discharge spaces of the discharge cells, which are provided between the upper substrate 10 and the barrier ribs 15 and between the lower substrate 18 and the barrier ribs 15.

This PDP is driven with one frame being time-divided into several sub-fields having a different number of emission in order to implement gray scales of images. For example, if it is sought to display images with 256 gray scales, a frame period (16.67 ms) corresponding to 1/60 seconds is divided into eight sub-fields (SF1 to SF8). Each of the eight sub-fields (SF1 to SF8) is divided into a reset period for initializing discharge cells, an address period for selecting discharge cells and a sustain period for implementing gray scales depending on the number of discharge. The reset period and the address period of each of the sub-fields (SF1 to SF8) are the same every sub-field, whereas the sustain period and the number of discharges increase in the ratio of $2^n$ (where, n=0, 1, 2, 3, 4, 5, 6, 7) in each sub-field.

Meanwhile, in the case where charge/discharge is generated in the PDP, there is almost no energy consumption only with capacitive load within the PDP. However, lots of energy loss is generated since a driving signal is generated with switching of AC power. More particularly, if excessive current flows within the discharge cell, energy loss is further increased. Such energy loss results in a raised temperature of switching elements. In the worst case, the raised temperature may break the switching elements. To recover energy that is unnecessarily generated within the panel, the driving circuit of the PDP comprises an energy recovery circuit as shown in FIG. 3.

Referring to FIG. 3, the energy recovery circuit comprises an inductor L that resonates along with a capacitive load Cp of the PDP, an external capacitor Cex for storing a voltage recovered from the capacitive load Cp of the PDP, switching elements S1 to S4 for switching a current path, and diodes D1, D2 for precluding an inverse current.

The capacitive load Cp of the PDP is formed between two electrodes in which a discharge is generated within each discharge cell. In FIG. 3, reference numeral "Re" equivalently indicates wiring resistance formed between the energy recovery circuit and the electrodes of the PDP. Reference numeral "R_Cp" equivalently indicates parasitic resistance existing in the discharge cell of the PDP. In addition, reference numeral "Vs" indicates an external sustain DC power source. The switching elements S1 to S4 are implemented using a semiconductor switching element such as a MOS FET element.

The operation of the energy recovery circuit constructed above will be described with reference to FIG. 4. FIG. 4 is a view for illustrating control signals of the energy recovery circuit and a voltage in each node according to each of the control signals. The external capacitor Cex is charged with a voltage as much as Vs/2 in an initial condition.

Referring to FIGS. 3 and 4, during a period t1, the first switching element S1 is closed according to the control signal (Er-up) from a timing controller (not shown) and is thus turned on. The remaining switching elements S2 to S4 keep turned off. At this time, electric charges stored in the external capacitor Cex are supplied to the inductor L via the first switching element S1 and the first diode D1. The inductor L constructs a serial LC resonant circuit along with the capacitive load Cp of the PDP. Therefore, at the period t1, the PDP starts being charged with a LC resonant waveform.

During a period t2, the first switching element S1 keeps turned on. The third switching element S3 is turned on in response to the control signal (Sus-up) from the timing controller. The second and fourth switching elements S3, S4 keep turned off. The capacitive load Cp of the PDP is charged with a sustain voltage (Vs), which is received via the third switching element S3. During the period t2, the capacitive load Cp of the PDP is kept to the sustain voltage (Vs).

During a period t3, the second switching element S2 is turned on, the fourth switching element S4 keeps turned off, and the first and third switching elements S1, S3 are turned off, in response to the control signal (Er-dn) from the timing controller. Therefore, invalid power from the capacitive load Cp of the PDP are recovered by the external capacitor Cex through the inductor L, the second diode and the second switching element S2.

During a period t4, the fourth switching element S4 is turned on, the second switching element S2 is turned off, and the first and third switching elements S1, S3 keep turned off, in response to the control signal (Sus-dn) from the timing controller. The capacitive load Cp of the PDP is discharged up to a base voltage (GND).

The operation of the second switching element of the switching elements forming the current path so that such an operation is performed will be described as follows.

FIG. 5 shows a bias circuit of the second switching element.

FIGS. 6*a* to 6*c* show a gate signal (FIG. 6*b*) and a Vgs (FIG. 6*c*) value depending on the application of a control signal (FIG. 6*a*) in the timing controller.

Referring to FIG. 5, the bias circuit of the second switching element ER-DN comprises a Zener diode ZD, which is connected between a first node n1 between a timing controller T/C and the gate terminal of the switching element and a second node n2 between the external capacitor Cex and the switching element. Between the first node n1 and the second node n2 is further provided a resistor R connected to the Zener diode ZD in parallel in order to prevent overload of the Zener diode. The Zener diode ZD generates a constant voltage of 15V if a current of an inverse direction flows through the first node n1 and the second node n2.

Referring to FIGS. 5 and 6, if a low signal (GND) is applied to the second switch in the timing controller T/C, a third node n3 has a voltage of Vs/2, which is charged by an external capacitor C. Since the second switch S2 is turned off, a voltage value of the gate terminal also has Vs/2. If a high signal of 15V is applied as the control signal during the period T1, a voltage value of the gate terminal becomes (Vs/2)+15V, and Vgs becomes 15V since it is a difference in a voltage value between the gate terminal and the source terminal.

As can be seen from the above operation, in the case where the low signal (GND) is applied from the timing controller to the third switching element, the value of Vgs must have 0V as shown in FIG. 6*c*. However, even when the low signal (GND) is applied as the control signal, an unwanted voltage may be generated from the second switching element. This will be described below with reference to FIG. 7, which shows a voltage value in the first node n1 and the second node n2 depending on the same timing shown in FIG. 4.

From FIG. 7, it can be seen that a voltage value at the first node n1 is abruptly varied at the start point and the end point of t1. The current is the amount of variation in a voltage according to a time. When the amount of variation in a voltage increases, an induced current is generated. This induced current generates an instant noise voltage within the second switching element whose Vgs value must be 0V during the period t1. This noise voltage generates, which may reduce and/or break the lifespan of the element. Furthermore, if the noise voltage exceeds Vth (3 to 5V), the switching element is operated to generate a malfunction.

SUMMARY OF THE INVENTION

Accordingly, the present invention has been made in view of the above problems occurring in the prior art, and it is an object of the present invention to provide a plasma display apparatus and driving method thereof, in which heat generated from circuit switching elements can be reduced and a malfunction can be obviated, thereby ensuring stable driving.

To accomplish the above, a plasma display apparatus according to the present invention comprises a PDP, an energy storage part for recovering energy from the PDP, and an energy supply and recovery controller that forms a current path so that the energy storage part can be charged or discharged. In the energy supply and recovery controller, a reference bias voltage is a negative voltage.

A plasma display apparatus according to the present invention comprises a PDP, and a driver including a capacitor for recovering energy from the PDP, a switching element that switches the path of a current charged into the capacitor according to a voltage between its gate terminal and its source terminal, and a bias circuit part that fixes a reference bias voltage between the gate terminal and the source terminal of the switching element to a negative voltage.

A driving method of a plasma display apparatus that is operated to supply energy to and recover energy from a PDP according to the present invention comprises the steps of supplying energy to the PDP, and maintaining a reference bias voltage of a recovery switch part to a negative voltage when energy is recovered from the PDP to an energy storage part.

The present invention is advantageous in that it can prevent a malfunction of circuits, which may be incurred by an induced current, thereby driving a PDP stably.

A plasma display apparatus according to the present invention comprises a PDP, an energy storage part for recovering energy from the PDP, and an energy supply and recovery controller that forms a current path so that the energy storage part can be charged or discharged. In the energy supply and recovery controller, a reference bias voltage is a negative voltage.

The energy supply and recovery controller may comprise a bias circuit part for fixing a reference bias voltage between a gate terminal and a source terminal of a switching element to a negative voltage.

The bias circuit part may comprise a first bias circuit that forms a positive bias voltage and a second bias circuit that forms a negative bias voltage.

The first bias circuit may comprise a first resistor and a first Zener diode, which are connected in parallel between the gate terminal of the switching element and one end of the second bias circuit. The second bias circuit may comprise a second resistor and a second Zener diode, which are connected in parallel between the source terminal of the switching element and one end of the first bias circuit.

The second bias circuit may be a negative constant voltage source.

The negative bias voltage of the second bias circuit may be set within a range of −10V to −2V.

The negative bias voltage may be a breakdown voltage of a second Zener diode.

The other end of the first bias circuit may be connected to a base voltage source.

A third resistor may be further connected between the other end of the first bias circuit and the base voltage source.

A plasma display apparatus according to the present invention comprises a PDP, and a driver including a capacitor for recovering energy from the PDP, a switching element that switches the path of a current charged into the capacitor according to a voltage between its gate terminal and its source terminal, and a bias circuit part that fixes a reference bias voltage between the gate terminal and the source terminal of the switching element to a negative voltage.

The bias circuit part may comprise a first bias circuit that forms a positive bias voltage and a second bias circuit that forms a negative bias voltage.

The first bias circuit may comprise a first resistor and a first Zener diode, which are connected in parallel between the gate terminal of the switching element and one end of the second bias circuit. The second bias circuit may comprise a second resistor and a second Zener diode, which are connected in parallel between the source terminal of the switching element and one end of the first bias circuit.

The second bias circuit may be a negative constant voltage source.

The negative bias voltage of the second bias circuit may be set within a range of −10V to −2V.

The negative bias voltage may be a breakdown voltage of a second Zener diode.

The other end of the first bias circuit may be connected to a base voltage source.

A third resistor may be further connected between the other end of the first bias circuit and the base voltage source.

A driving method of a plasma display apparatus that is operated to supply energy to and recover energy from a PDP according to the present invention comprises the steps of supplying energy to the PDP, and maintaining a reference bias voltage of a recovery switch part to a negative voltage when energy is recovered from the PDP to an energy storage part.

The negative voltage may be set within a range of −10V to −5V.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

A plasma display apparatus and driving method thereof according to the present invention will now be described in detail with reference to the accompanying drawings.

Figure 8:
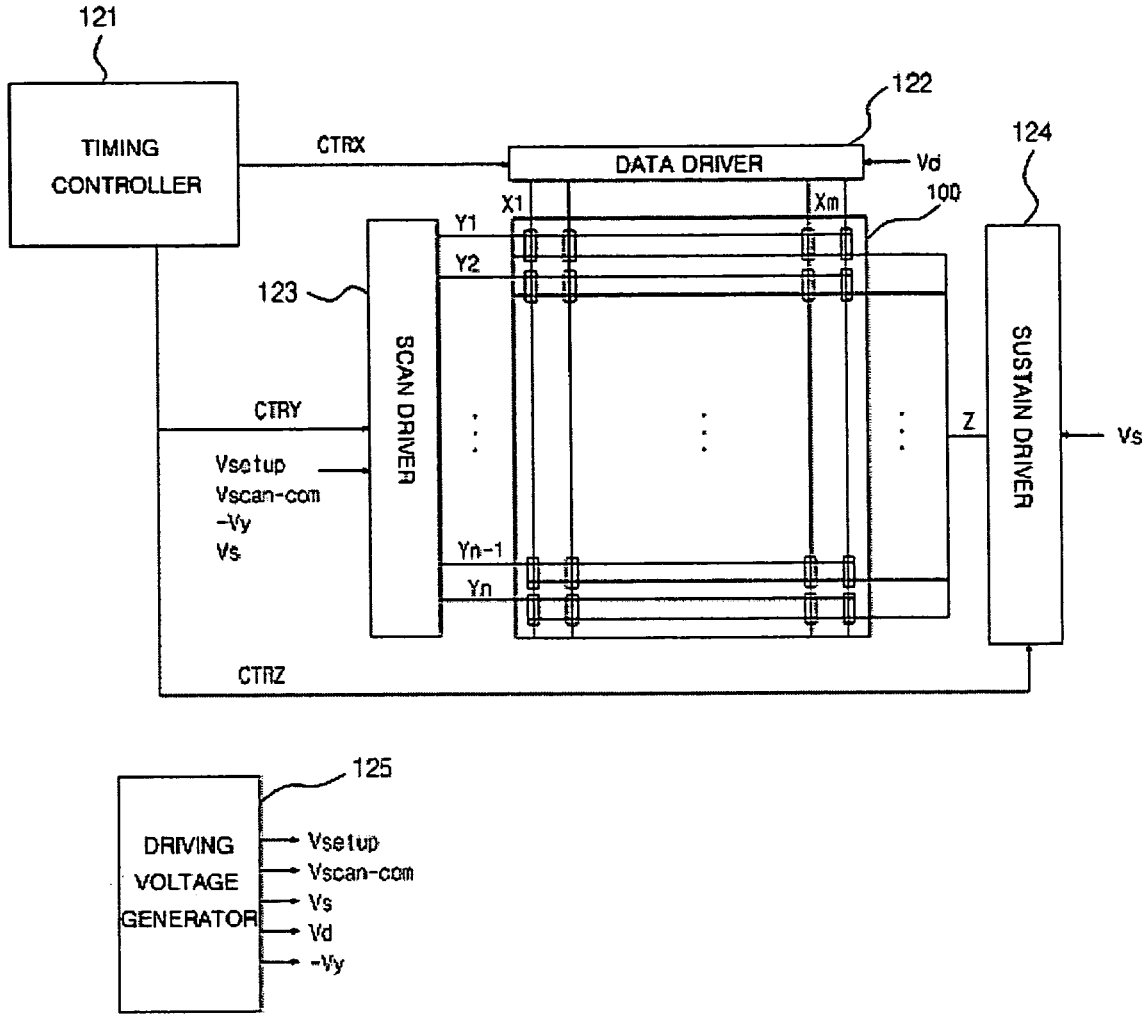
FIG. 8 is a block diagram schematically showing the construction of a plasma display apparatus according to the present invention.

FIG. 8 is a block diagram schematically showing the construction of a plasma display apparatus according to the present invention.

As shown in FIG. 8, the plasma display apparatus according to the present invention comprises a PDP 100, a data driver 122 for supplying data to address electrodes X1 to Xm formed in a lower substrate (not shown) of the PDD 100, a scan driver 123 for driving scan electrodes Y1 to Yn, a sustain driver 124 for driving sustain electrodes Z, i.e., a common electrode, a timing controller 121 for controlling the data driver 122, the scan driver 123 and the sustain driver 124 when the PDP is driven, and a driving voltage generator 125 for supplying driving voltages necessary for the respective drivers 122, 123 and 124.

In the plasma display apparatus constructed above, each of a plurality of sub-fields is divided into a reset period, an address period and a sustain period, and predetermined signals are applied to the electrodes in each period, thereby representing images.

The PDP 100 comprises an upper substrate (not shown) and a lower substrate (not shown), which are adhered together with a predetermined distance therebetween. A plurality of electrodes, such as the scan electrodes Y1 to Yn and the sustain electrode Z, is formed in pairs in the upper substrate. In the lower substrate are formed the address electrodes X1 to Xm crossing the scan electrodes Y1 to Yn and the sustain electrode Z.

The data driver 122 are supplied with data, which undergo inverse gamma correction, error diffusion, etc. through an inverse gamma correction circuit (not shown), an error diffusion circuit (not shown), etc., and are then mapped to respective sub-fields by a sub-field mapping circuit. The data driver 122 samples and latches data in response to a timing control signal (CTRX) from the timing controller 121 and supplies the data to the address electrodes X1 to Xm.

The scan driver 123 supplies a ramp-up waveform (Ramp-up) and a ramp-down waveform (Ramp-down) to the scan electrodes Y1 to Yn under the control of the timing controller 121 during the reset period. The scan driver 123 also sequentially supplies scan pulses (Sp) of a scan voltage (−Vy) to the scan electrodes Y1 to Yn under the control of the timing controller 121 during the address period, and supplies a sustain pulse generated by an energy recovery circuit provided therein to the scan electrodes during the sustain period.

The sustain driver 124 applies a bias voltage of a sustain voltage (Vs) to the sustain electrodes Z during a period where the ramp-down waveform (Ramp-down) is generated and during the address period under the control of the timing controller 121. A sustain driving circuit provided within the sustain driver 124 alternately operates with the energy recovery circuit provided within the scan driver 123 to supply the sustain pulse (sus) to the sustain electrodes Z during the sustain period.

The timing controller 121 receives vertical/horizontal sync signals and a clock signal, generates timing control signals (CTRX, CTRY and CTRZ) for controlling an operating timing and synchronization of the respective drivers 122, 123 and 124 in the reset period, the address period and the sustain period, and provides the timing control signals (CTRX, CTRY and CTRZ) to corresponding drivers 122, 123 and 124, thereby controlling the respective drivers 122, 123 and 124.

Meanwhile, the data control signal (CTRX) comprises a sampling clock for sampling data, a latch control signal, and a switching control signal for controlling an on/off time of a driving switch element. The scan control signal (CTRY) comprises a switching control signal for controlling an on/off time of a scan driving circuit, an energy recovery circuit and a driving switch element within the scan driver 123. The sustain control signal (CTRZ) comprises a switching control signal for controlling an on/off time of an energy recovery circuit and a driving switch element within the sustain driver 124.

The driving voltage generator 125 generates the set-up voltage (Vsetup), the scan common voltage (Vscan-com), the scan voltage (−Vy), the sustain voltage (Vs), the data voltage (Vd), and the like. These driving voltages can vary depending upon the composition of a discharge or the structure of a discharge cell.

In the plasma display apparatus constructed above, sustain pulses, which are generated by the operation of the energy recovery circuits comprised in the scan driving circuit and the sustain driving circuit, are supplied to the PDP. The structure of the energy recovery circuit will be described with reference to FIG. 9.

Figure 9:
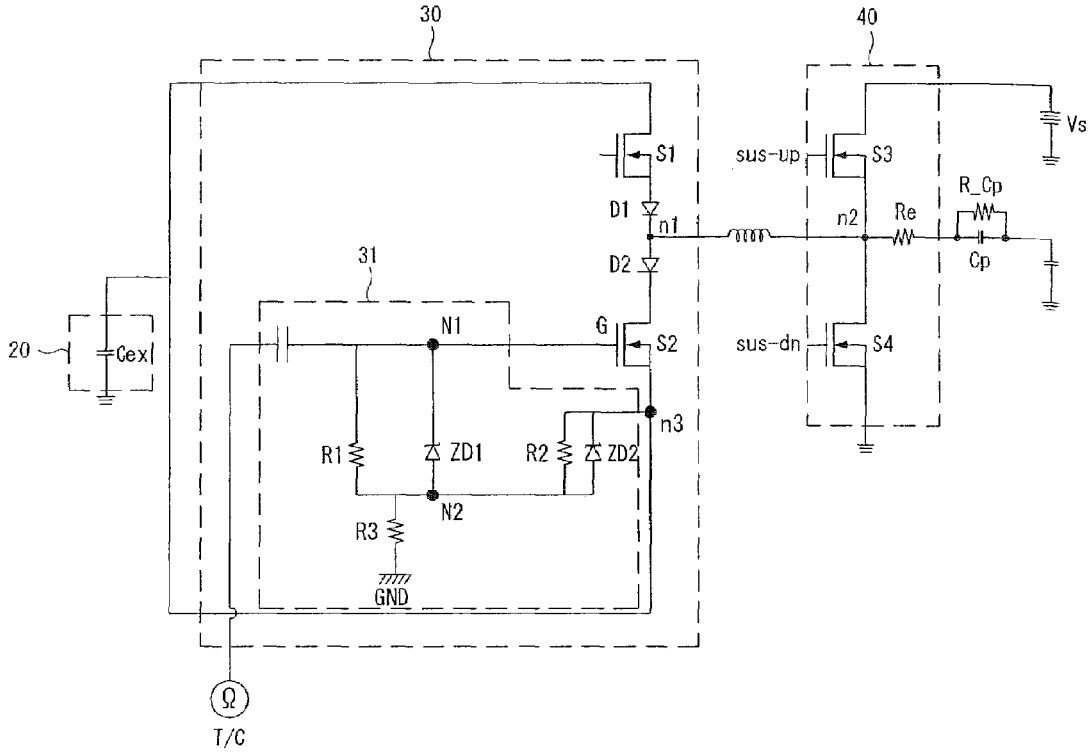
FIG. 9 is a circuit diagram showing the construction of an energy recovery circuit of the plasma display apparatus according to the present invention.

FIG. 9 is a circuit diagram showing the construction of the energy recovery circuit of the plasma display apparatus according to the present invention.

The energy recovery circuit according to the present invention comprises an energy storage part 20 for supplying energy to or recovering energy from the capacitive load Cp of the PDP, an energy supply and recovery controller 30 that forms a current path so that the energy storage part is charged or discharged, an inductor L for supplying energy to or recovering energy from the capacitive load Cp of the PDP using the energy supply and recovery controller 30 or forming a resonant circuit upon recovery, and a sustain voltage controller 40 for applying a sustain voltage after energy is supplied to the PDP and maintaining the PDP to a ground voltage after energy is recovered from the PDP.

In the operation of the energy recovery circuit according to the present invention, when the plasma display apparatus is driven, a sustain pulse is supplied to the PDP by means of the operation of switching elements respectively comprised in the controllers 30, 40 during the sustain period, as described above in the prior art. A bias circuit part 31 comprised in the energy supply and recovery controller 30 is kept to a negative bias voltage. The bias circuit part 31 can be connected to a first switching element S1 and a second switching element S2 of the energy supply and recovery controller 30, but is preferably connected to the second switching element that is operated when energy is recovered from the PDP.

Figure 1:
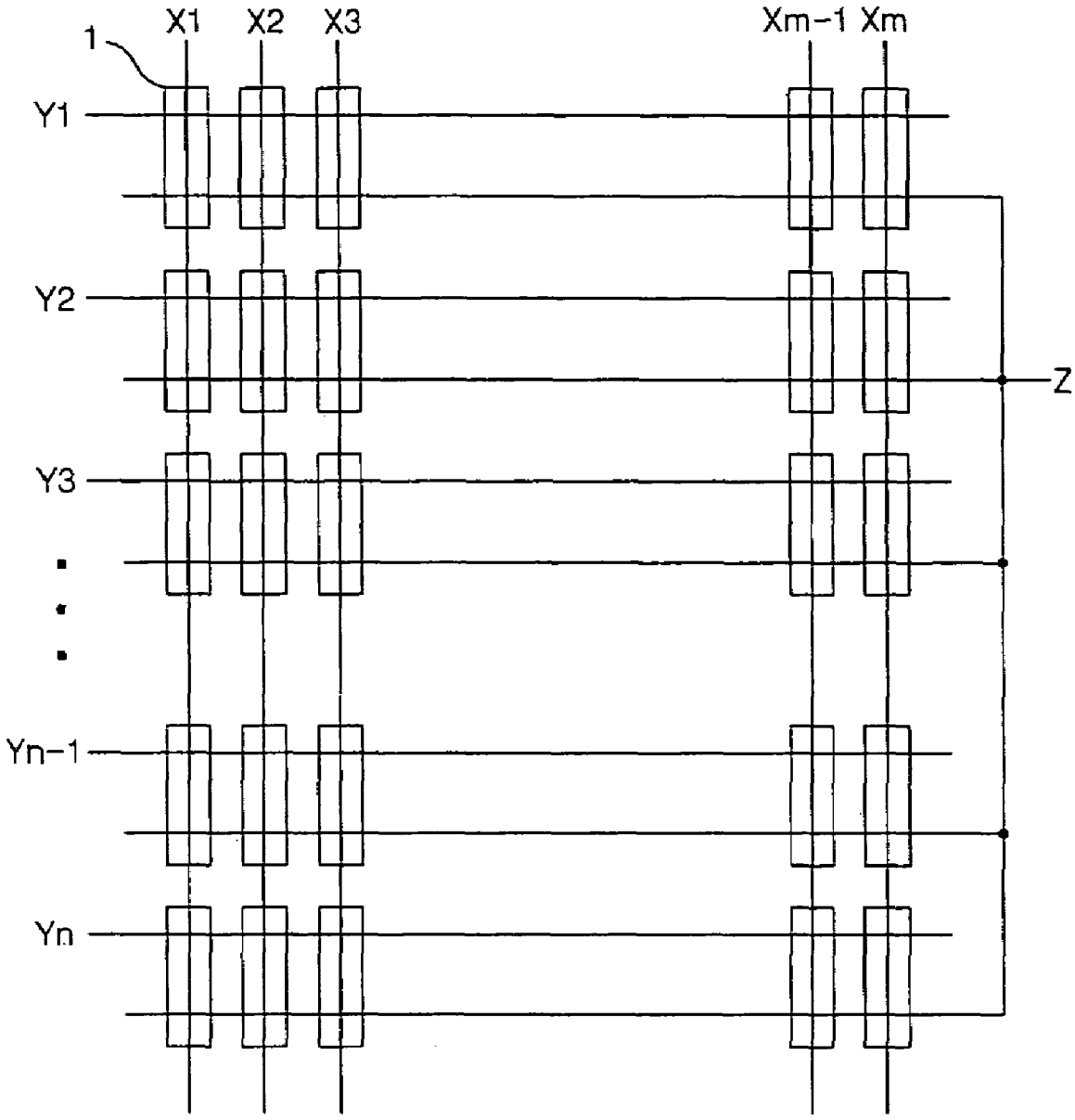
FIG. 1 is a plan view schematically showing the disposition of electrodes of a conventional three-electrode AC surface discharge type PDP.
Figure 2:
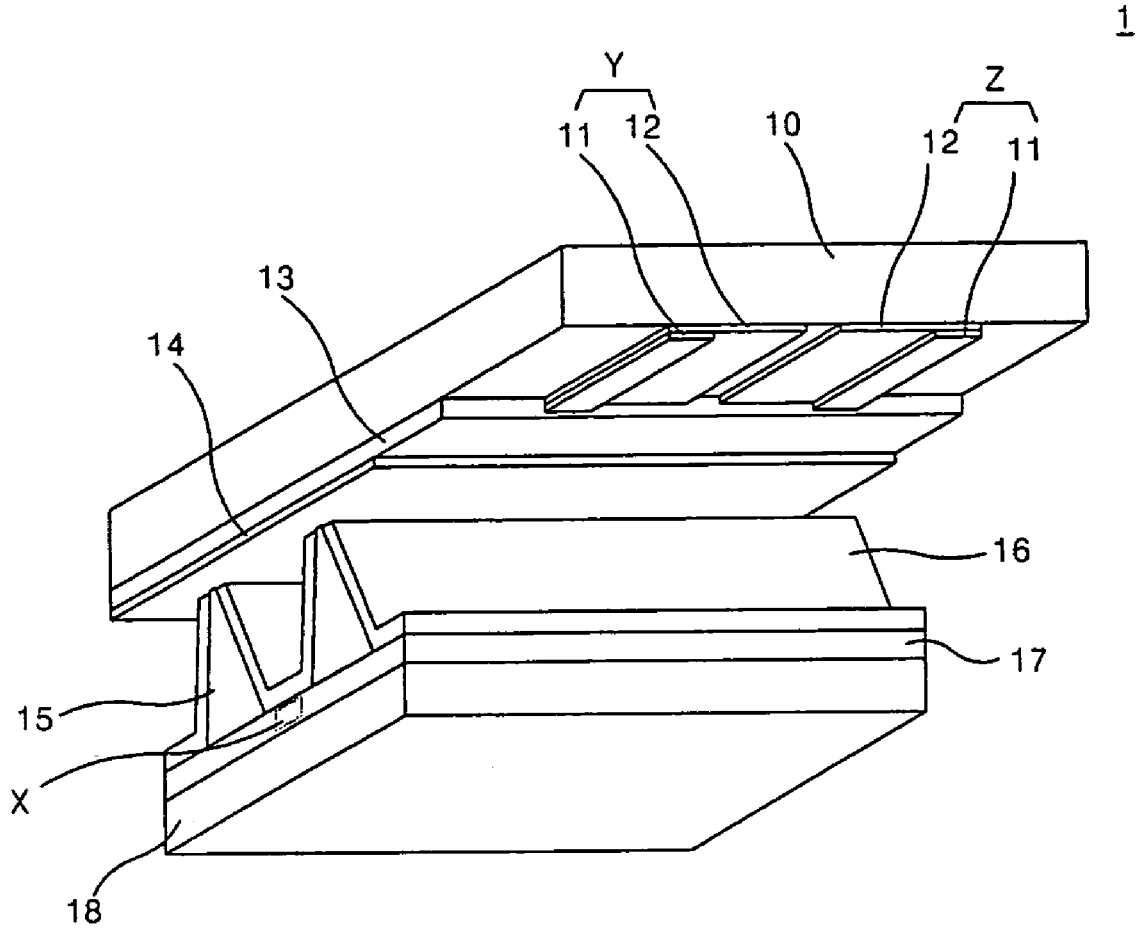
FIG. 2 is a detailed perspective view of the construction of a discharge cell shown in FIG. 1.
Figure 3:
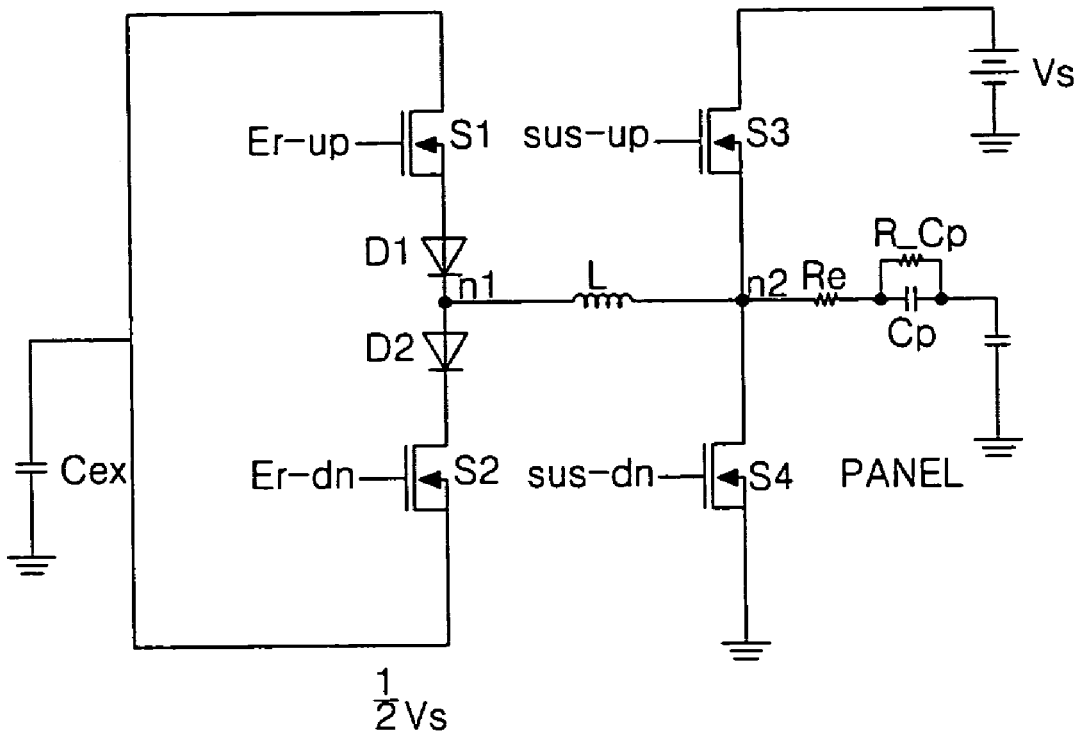
FIG. 3 is a circuit diagram of a conventional energy recovery circuit.
Figure 4:
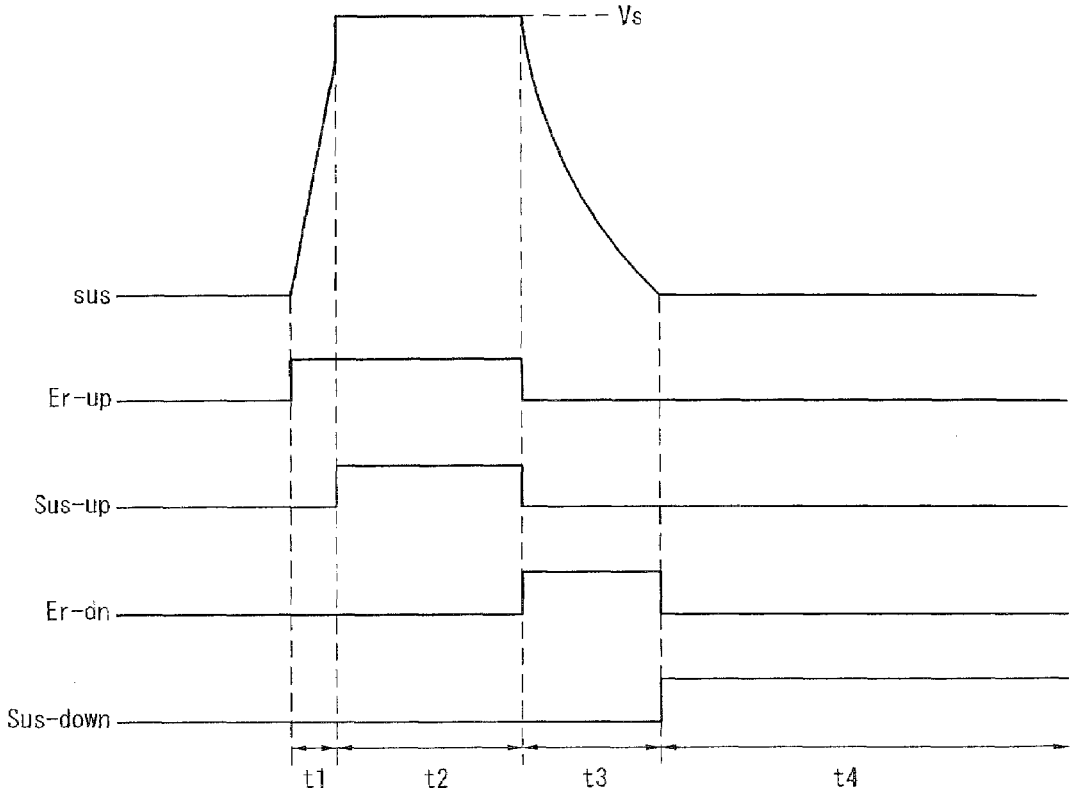
FIG. 4 is a waveform illustrating control signals of the energy recovery circuit shown in FIG. 3.
Figure 5:
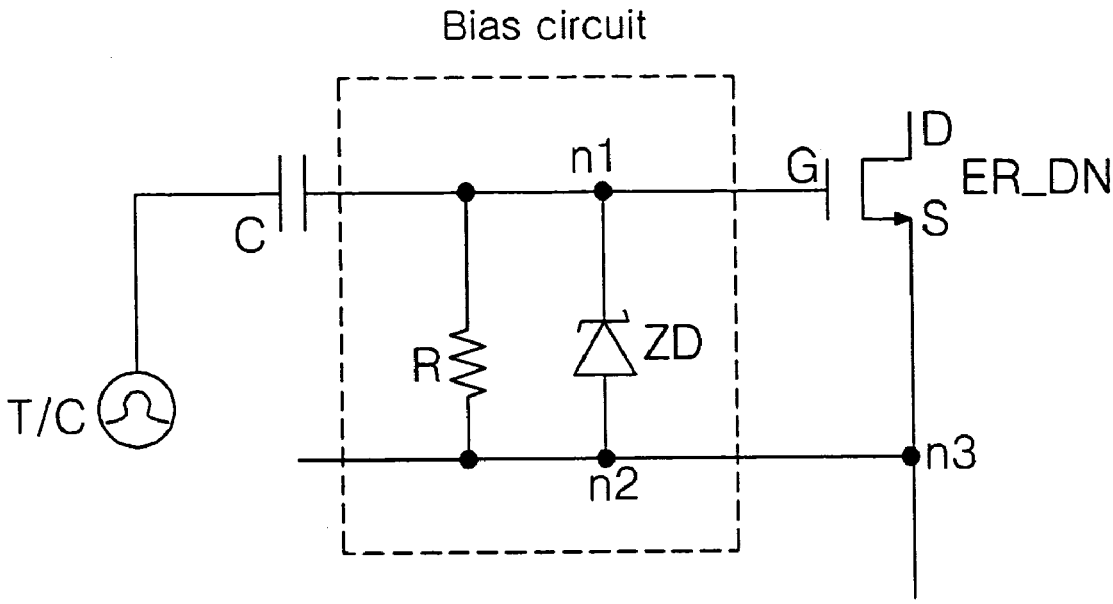
FIG. 5 is a circuit diagram of a second switching element shown in FIG. 3.
Figure 6A:
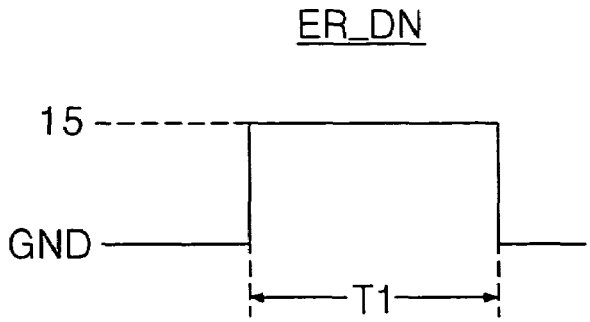
FIGS. 6*a* to 6*c* are waveforms illustrating a voltage value of each node point of the second switching element.
Figure 6B:
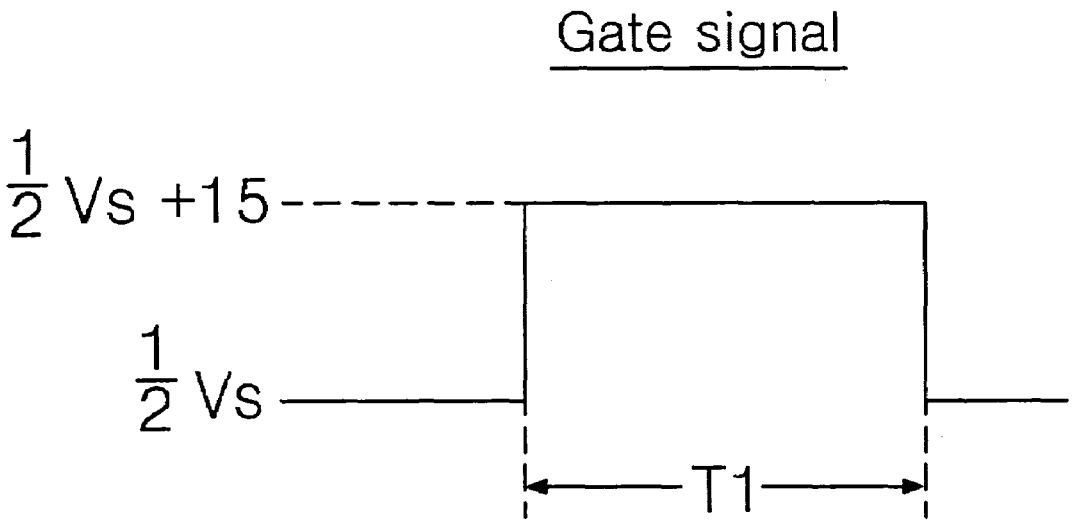
Figure 6C:
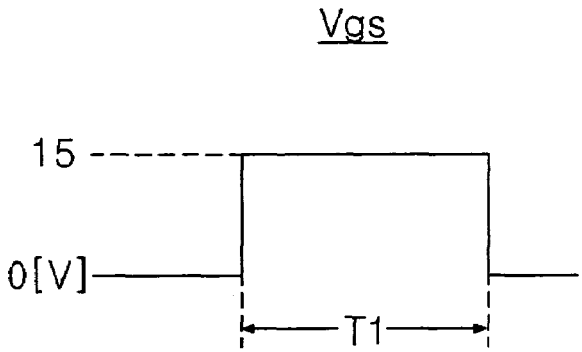

The operation of the energy recovery circuit according to the present invention will be described in detail with reference to FIG. 4. During the period t1, the first switching element S1 is turned on in response to the control signal (Er-up) from the timing controller and the remaining switching elements S2 to S4 keep turned off. In this case, charges stored in the energy storage part 20 are supplied to the inductor L via the first switching element S1 and the first diode D1 and the inductor L constitutes the serial LC resonant circuit along with the capacitive load Cp of the PDP. Therefore, during the period t1, the PDP starts being charged with a LC resonant waveform.

A reference bias voltage has a negative voltage according to the control signal of the timing controller T/C so that the second switching element keeps turned off. This will be described below in more detail.

Figure 10:
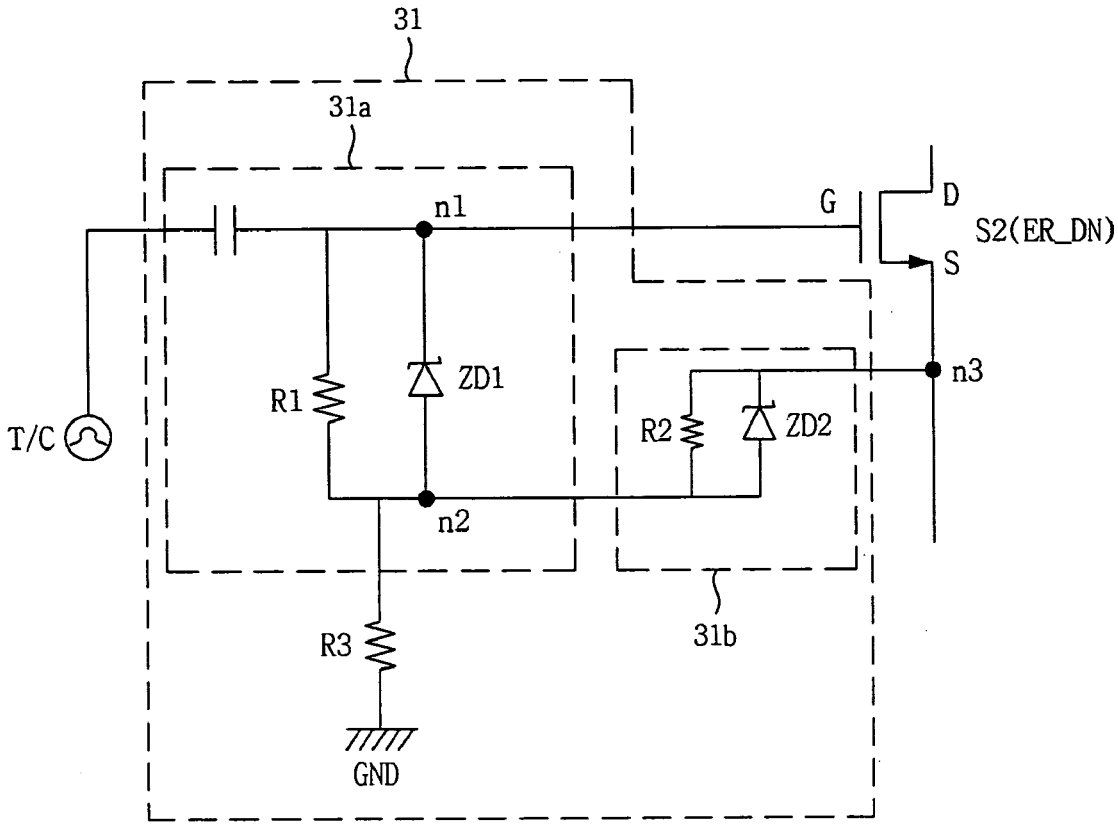
FIG. 10 is a circuit diagram of a second switching element of the energy recovery circuit according to the present invention.
Figure 11A:
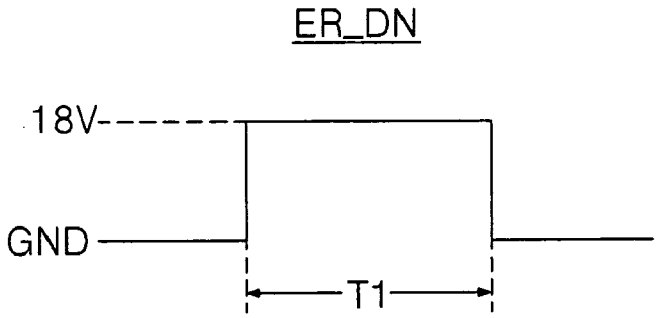
FIGS. 11*a* to 11*c* are views showing a gate signal (11*b*) of the switching element according to a control signal (11*a*) of a timing controller T/C of the plasma display apparatus according to the present invention and a voltage value (Vgs)(11*c*) between the gate terminal and the source terminal of the switching element.
Figure 11B:
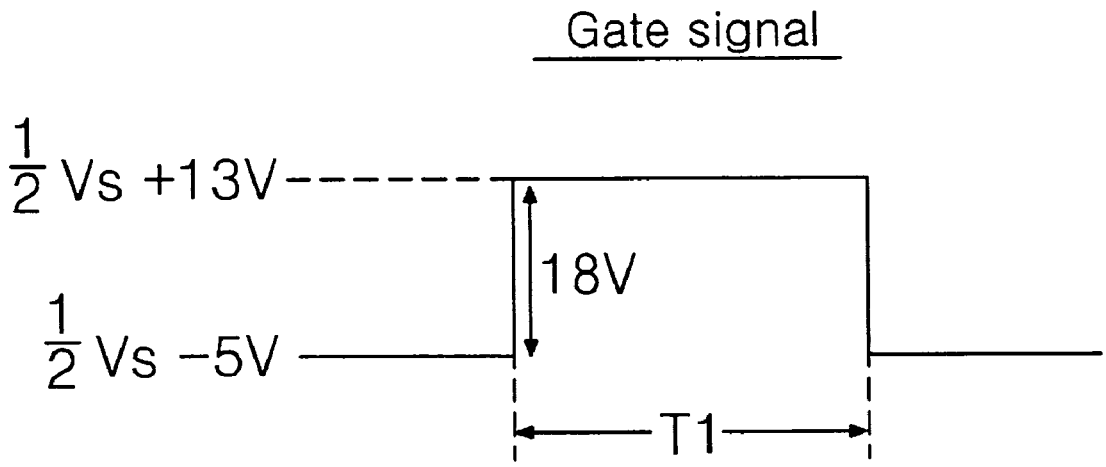
Figure 11C:
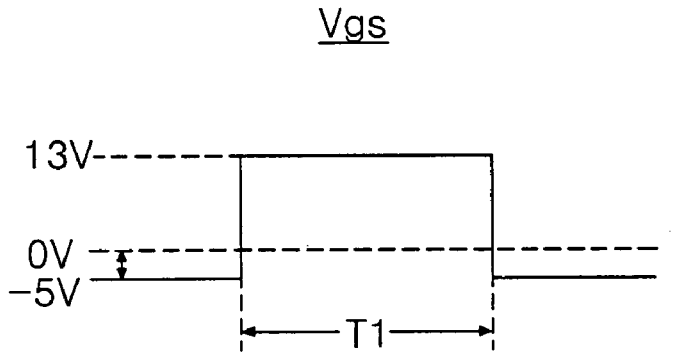

FIG. 10 is a circuit diagram of the second switching element of the energy recovery circuit according to the present invention. FIGS. 11*a* to 11*c* are views showing a gate signal (11*b*) of the switching element according to a control signal (11*a*) of a timing controller (T/C) of the plasma display apparatus according to the present invention and a voltage value (Vgs)(11*c*) between the gate terminal and the source terminal of the switching element.

Referring to FIG. 10 and FIGS. 11*a* to 11*c*, the bias circuit 31 of the second switching element S2 according to the present invention comprises a first bias circuit 31*a* including a first resistor R1 and a first Zener diode ZD1, which are connected in parallel between the gate terminal of the second switching element and one end of a second bias circuit 31*b*, and the second bias circuit 31*b* including a second resistor R2 and a second Zener diode ZD2, which are connected in parallel between the source terminal of the second switching element and the first bias circuit. Furthermore, the other end of the first bias circuit 31*a* is connected to a base voltage source (GND). A third resistor R3 is also connected between the other end of the first bias circuit 31*a* and the base voltage source (GND).

The other end of the first bias circuit forms a positive bias voltage and the second bias circuit forms a negative bias voltage.

The first Zener diode ZD1 generates a constant voltage of 18V when a current of an inverse direction flows through the first node n1 and the second node n2. The second Zener diode ZD2 generates a constant voltage of 5V when a current of an inverse direction flows through the third node n3 and the second node n2. That is, the breakdown voltage of the second Zener diode is 5V.

It has been described that the second Zener diode ZD2 generates a constant voltage of 5V when a current of an inverse direction flows through the third node n3 and the second node n2. However, the range of the constant voltage can be set within a range of 2V to 10V depending on the amount of an induced current generated when the energy recovery circuit is operated.

The first and second resistors R1, R2 function to prevent overload from being given to the first and second Zener diodes ZD1, ZD2.

In the case where the control signal is applied to the second switching element as a low signal (GND) by the timing controller T/C, the second switching element keeps turned off. Since the third node n3 has a voltage Vs/2 by charges charged in the energy storage part 20, a voltage value of the second node n2 becomes Vs/2-5V. Therefore, the gate terminal has a voltage value of Vs/2-5V, and a voltage difference (Vgs) between the gate terminal of the second switch and the source terminal becomes −5V. That is, the reference bias voltage of the second bias circuit has a negative voltage of −5V not 0V in the prior art.

If the control signal is applied to the second switching element as the high signal 18V) by the timing controller T/C, the gate terminal of the second switching element rises from Vs/2-5V to 18V. In a state where the source terminal of the second switching element has the same voltage value, a voltage of the gate terminal rises. Therefore, the voltage difference (Vgs) between the gate terminal of the second switching element and the source terminal also becomes 13V.

In the second switching element operating as described above, the second switching element can be driven stably since the bias voltage has a negative voltage of −5V not conventional 0V.

Meanwhile, in the present invention, it has been described that when the second switching element is turned off, the bias voltage of the second bias circuit is generated as a negative voltage by the Zener diode. Since the second switching element is kept to a negative bias voltage when it is turned off, the second bias circuit can be constructed of a negative constant voltage source.

This will be described below in connection with description of FIG. 7, which is the aforementioned problem of the prior art.

Figure 7:
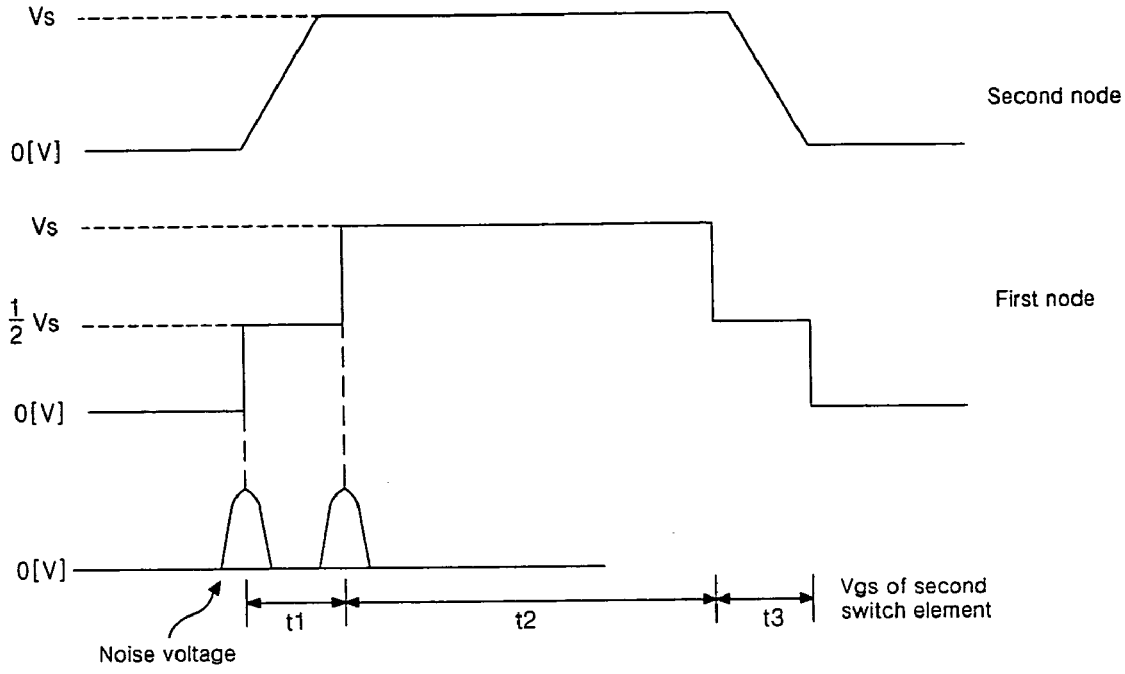
FIG. 7 is a waveform illustrating a voltage value of each node point shown in FIG. 3.

Referring to FIG. 7, a voltage value at the first node n1 is abruptly changed at the start point and the end point of t1, so that an induced current is generated. The voltage difference (Vgs) value between the gate terminal and the source terminal of the second switching element must be 0V by means of such induced current during the period t1. However, an instant noise voltage, i.e., a voltage (Vth) higher than a reference value is generated within the second switching element. This leads to a malfunction of the second switch.

In the second switching element, i.e., the ER_DN switch of the energy recovery circuit according to the present invention, however, the reference bias voltage is set to a negative voltage of −5V so that the bias voltage does not exceed 0V even if a noise voltage is generated at the start point and the end point of t1. This can prevent a malfunction, which is generated since the voltage difference (Vgs) between the gate terminal and the source terminal of the second switching element becomes the voltage (Vth) higher than a reference value.

During the period t2, the first switching element S1 keeps turned on, the second switching element S2 is turned on in response to the control signal (Sus-up) of the timing controller and the third and fourth switching elements S3, S4 keep turned off. Therefore, the capacitive load Cp of the PDP is charged with the sustain voltage (Vs) received through the second switching element S2. During the period t2, the capacitive load Cp of the PDP is kept to the sustain voltage (Vs).

During the period t3, the second switching element S2 is turned on in response to the control signal (Er-dn) from the timing controller, the fourth switching element S4 keeps turned off and the first and third switching elements S1, S3 are turned off. Therefore, invalid power from the capacitive load Cp of the PDP is recovered by the external capacitor Cex through the inductor L, the second diode and the second switching element S2.

During the period t4, the fourth switching element S4 is turned on in response to the control signal (Sus-dn) from the timing controller, the second switching element S2 is turned off and the first and third switching elements S1, S3 keep turned off. Therefore, the capacitive load Cp of the PDP is discharged up to the base ground (GND).

The invention being thus described, it will be obvious that the same may be varied in many ways. Such variations are not to be regarded as a departure from the spirit and scope of the invention, and all such modifications as would be obvious to one skilled in the art are intended to be comprised within the scope of the following claims.

What is claimed is:

1. A plasma display apparatus, comprising:

a Plasma Display Panel (PDP);

an energy storage part for recovering energy from the PDP; and an energy supply and recovery controller that forms a current path so that the energy storage part can be charged or discharged, wherein the energy supply and recovery controller comprises a bias circuit part for fixing a reference bias voltage between a gate terminal and a source terminal of a switching element to a negative voltage, wherein the bias circuit part comprises a first bias circuit that forms a positive bias voltage and a second bias circuit that forms a negative bias voltage, and wherein the first bias circuit comprises a first resistor and a first Zener diode which are connected in parallel between the gate terminal of the switching element and one end of the second bias circuit, and the second bias circuit comprises a second resistor and a second Zener diode, which are connected in parallel between the source terminal of the switching element and one end of the first bias circuit.

2. The plasma display apparatus as claimed in claim 1, wherein the second bias circuit is a negative constant voltage source.

3. The plasma display apparatus as claimed in claim 1, wherein the negative bias voltage of the second bias circuit is set within a range of −10V to −2V.

4. The plasma display apparatus as claimed in claim 3, wherein the negative bias voltage is a breakdown voltage of a second Zener diode.

5. The plasma display apparatus as claimed in claim 1, wherein the other end of the first bias circuit is connected to a base voltage source.

6. The plasma display apparatus as claimed in claim 5, wherein a third resistor is connected between the other end of the first bias circuit and the base voltage source.

7. A plasma display apparatus, comprising:

a PDP; and a driver including a capacitor for recovering energy from the PDP, a switching element that switches the path of a current charged into the capacitor according to a voltage between its gate terminal and its source terminal, and a bias circuit part that fixes a reference bias voltage between the gate terminal and the source terminal of the switching element to a negative voltage, wherein the bias circuit part comprises a first bias circuit that forms a positive bias voltage and a second bias circuit that forms a negative bias voltage, and wherein the first bias circuit comprises a first resistor and a first Zener diode which are connected in parallel between the gate terminal of the switching element and one end of the second bias circuit, and the second bias circuit comprises a second resistor and a second Zener diode, which are connected in parallel between the source terminal of the switching element and one end of the first bias circuit.

8. The plasma display apparatus as claimed in claim 7, wherein the second bias circuit is a negative constant voltage source.

9. The plasma display apparatus as claimed in claim 7, wherein the negative bias voltage of the second bias circuit is set within a range of −10V to −2V.

10. The plasma display apparatus as claimed in claim 9, wherein the negative bias voltage is a breakdown voltage of a second Zener diode.

11. The plasma display apparatus as claimed in claim 7, wherein the other end of the first bias circuit is connected to a base voltage source.

12. The plasma display apparatus as claimed in claim 11, wherein a third resistor is connected between the other end of the first bias circuit and the base voltage source.

* * * * *